United States Patent [19]

Marais

[11] Patent Number: 4,561,144

[45] Date of Patent: Dec. 31, 1985

[54] MACHINE FOR WASHING FLAT TABLEWARE

[75] Inventor: Jacques Marais, Villeneuve d'Ascq, France

[73] Assignee: Fast Lunch Societe Anonyme dite, Villeneuve d'Ascq, France

[21] Appl. No.: 516,049

[22] Filed: Jul. 20, 1983

[30] Foreign Application Priority Data

Jul. 29, 1982 [FR] France ..... 82 13272

[51] Int. Cl.[4] ..... A47L 15/24; A47L 15/48; A47L 15/37; B08B 1/02

[52] U.S. Cl. ..... 15/302; 15/306 B; 134/25.2; 134/30; 134/133

[58] Field of Search ..... 134/6, 25.2, 30, 67, 134/68, 72, 82, 83, 85, 86, 133, 134; 15/77, 102, 302, 306 B, 308

[56] References Cited

U.S. PATENT DOCUMENTS

| | | | |
|---|---|---|---|
| Re. 25,486 | 11/1963 | Nolte | 134/25.2 |
| 2,363,491 | 11/1944 | Bagnall | 134/68 |
| 2,633,437 | 3/1953 | Detjen | 134/25.2 |
| 2,764,170 | 9/1956 | Messler et al. | 134/68 |
| 3,798,065 | 3/1974 | Kitterman et al. | 134/25.2 |
| 3,999,238 | 12/1976 | Hanson | 15/77 |
| 4,473,922 | 10/1984 | Weihe | 15/306 B |

*Primary Examiner*—Marc L. Caroff
*Assistant Examiner*—W. Gary Jones
*Attorney, Agent, or Firm*—Patrick F. Henry

[57] ABSTRACT

The present invention relates to a process for mechanically washing articles of flat tableware, such as plates, saucers or the like, conveyed continuously, said process comprising the steps of subjecting the articles to a wet phase by rotary brushing under a projection of detergent water and then subjecting them to a phase of physical elimination of the wet residue by projection of a flat jet of air over the whole surface of the articles, maintained in inclined position, the flat jet of air pushing the remanent liquid film in the direction of gravity. It also relates to a machine for carrying out this process, of the type comprising a station for brushing provided with means for projecting detergent water, a tank of detergent water supplied by the return by gravity of the water coming from said wet brushing station, means for recycling the water from this tank towards the detergent water projecting means, said machine further comprising, immediately downstream of said wet brushing station, means for projecting a flat jet of air adapted to scrape and physically eliminate the wet film remaining on the surface of the articles.

3 Claims, 8 Drawing Figures

MACHINE FOR WASHING FLAT TABLEWARE

The present invention relates to a process and to a machine for carrying out this process, for washing articles of flat tableware such as in particular trays, dishes, plates, saucers or the like, economically and entirely automatically.

The invention will be employed more particularly for the equipment of installations set up in premises where collective meals are dispensed, such as traditional restaurants, self-service restaurants, cafeterias, canteens, refectories, fast-food restaurants, etc.

Heretofore known machines for automatically washing dishes in such premises all present a certain number of drawbacks, in particular the dimensions thereof, the manipulations necessary for loading and unloading, excessive consumption of water and energy and, finally, an unsatisfactory state of the tableware, due to the deposit of concentrated active products on the surface after drying.

It is an object of the invention to overcome these various drawbacks and it proposes, to this end, a process and a machine applying a new methodology and more efficient, more compact and totally automatic equipment.

As will be seen in the course of the present specification, the dish-washing process consists in one wet operation of washing in water containing detergent, which is recycled after filtration and maintained at a moderate temperature of the order of 60° C., whilst the washing water and the active products that it contains is eliminated from the surface of the articles not by wet rinsing but by physical scraping, preferably by means of a nozzle ejecting a flat jet of air driving the wet film in the direction of gravity.

The machine according to the invention may be supplied with a stack of dirty flat tableware corresponding to a certain quantity, positioned in a standard container, the staff not having to position the tableware in the machine; such positioning is effected automatically at a supply station, whilst the machine continuously restores a quantity or stack of clean tableware available for immediate re-use.

More particularly, the invention relates to a process for mechanically washing articles of flat tableware, such as plates, saucers or the like, conveyed continuously, said process comprising the steps of subjecting the articles to a wet phase by rotary brushing under a projection of detergent water and then subjecting them to a phase of physical elimination of the wet residue by projection of a flat jet of air over the whole surface of the articles, maintained in inclined position, the flat jet of air pushing the remanent liquid film in the direction of gravity.

According to this process, the articles are conveyed in upwardly inclined position all along the path, both during the phase of brushing under the projection of detergent water and in the course of the phase of elimination of the remanent wet film, the angle of advance of the articles being between 10° and 30°.

The invention also relates to a machine for carrying out the above process, and comprising a station for brushing under a projection of detergent water, a tank of detergent water supplied by the return by gravity of the water coming from said wet brushing station, means for recycling the water from this tank towards the detergent water projecting means, and, immediately downstream of said wet brushing station, means for projecting a flat jet of air adapted to scrape and physically eliminate the wet film remaining on the surface of the articles.

The invention will be more readily understood on reading the following description with reference to the accompanying drawings, in which.

Figure 1:
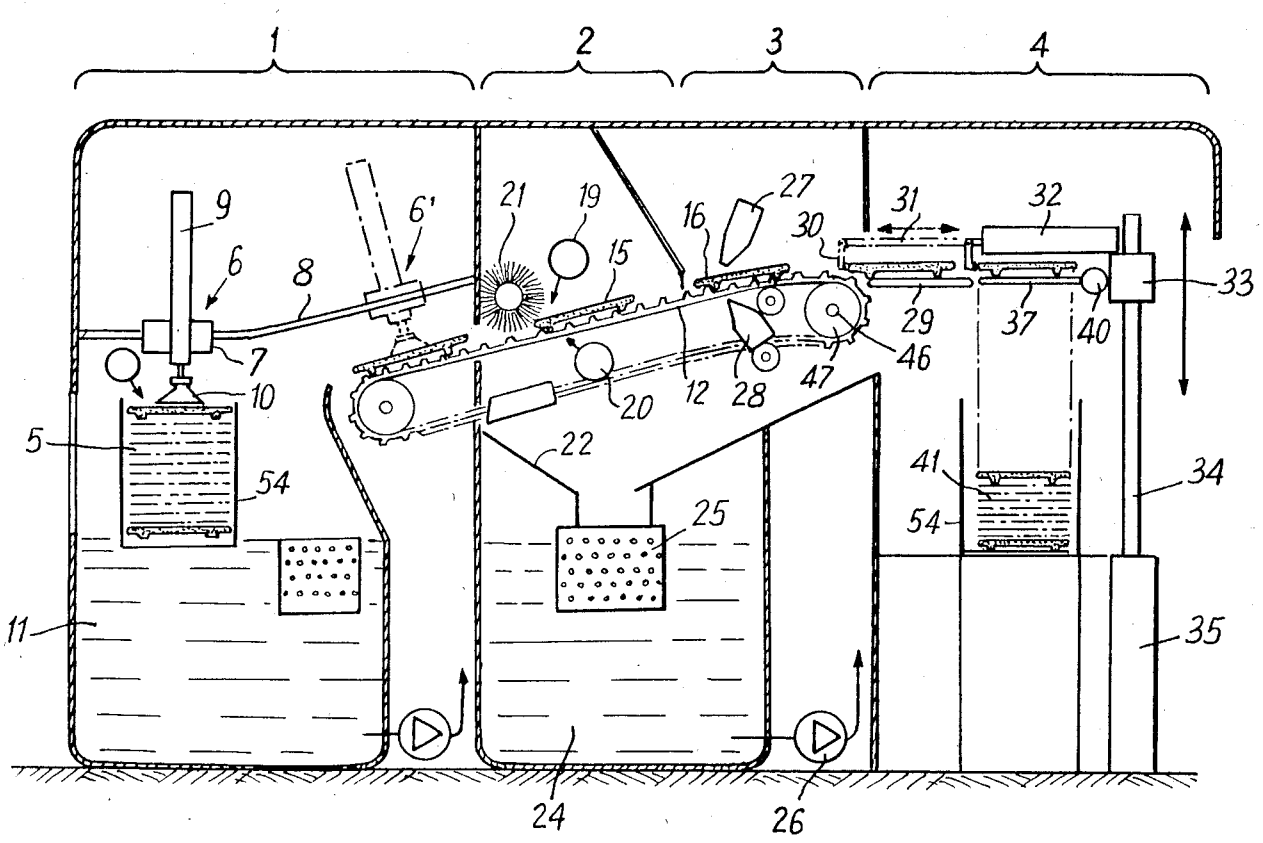
FIG. 1 is a schematic view in longitudinal section of the whole installation according to the invention.

Referring now to the drawings, all the Figures show that the device according to the invention is essentially constituted by a washing station 2 followed by a station 3 for physically eliminating the wet film, these two stations, coupled together, constituting the heart of the machine or device.

Upstream is located the supply station 1 supplying from the upstream stack 5 of dirty articles, whilst, downstream is located the station 4 for restacking the clean articles into piles 41.

Figure 6:
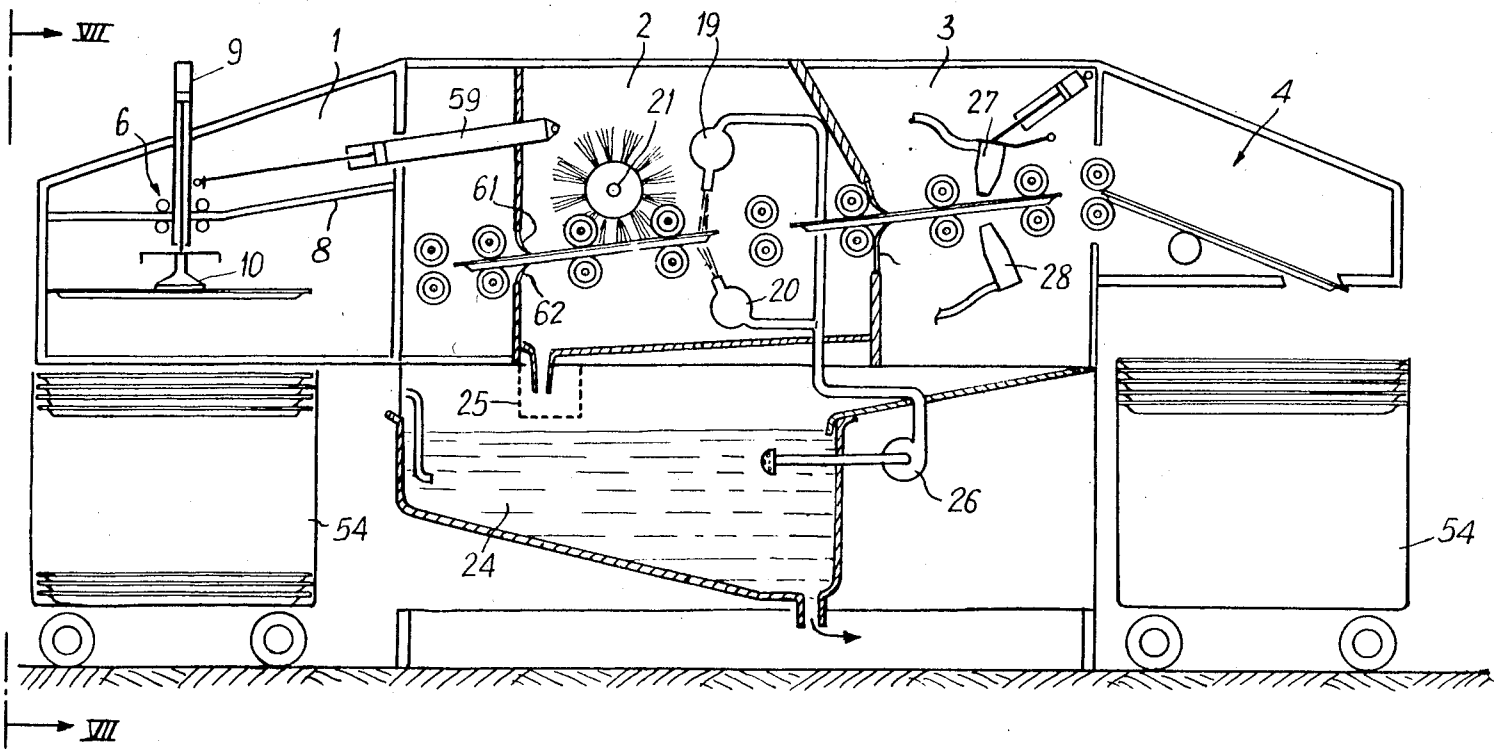
FIG. 6 is a schematic general view of the invention in longitudinal section, according to a variant via lateral moving rollers adapted to convey trays.
Figure 7:
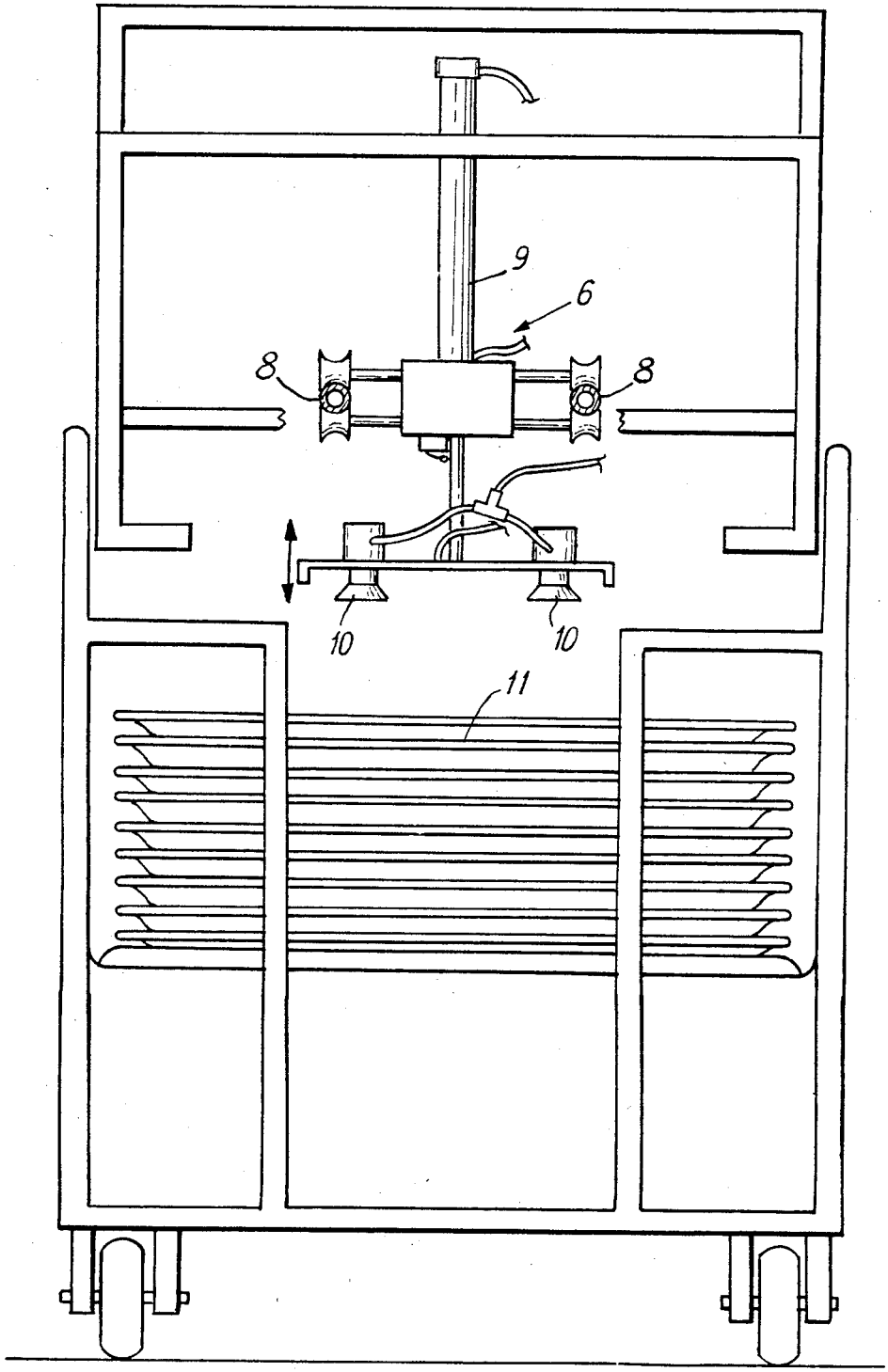
FIG. 7 is a view in rear elevation of the machine along line II—II of FIG. 6.

According to the invention, the machine is supplied from containers 54 constituting interchangeable cases and which will be used for storing, transporting and receiving the clean articles at the downstream station 4, and for positioning the stack 5 of dirty articles intended to be washed in the machine. Said containers may be mounted on rolling elements to constitute carriages, as seen in FIGS. 6 and 7.

The stack of tableware 5 is positioned at the downstream station 1 inside a standard container to allow operation and gripping of the pick-up members shown schematically at 6 (FIG. 1) and which are shown in starting position (in solid lines) and in finishing position 6' for supplying the machine (in broken lines).

Figure 8:
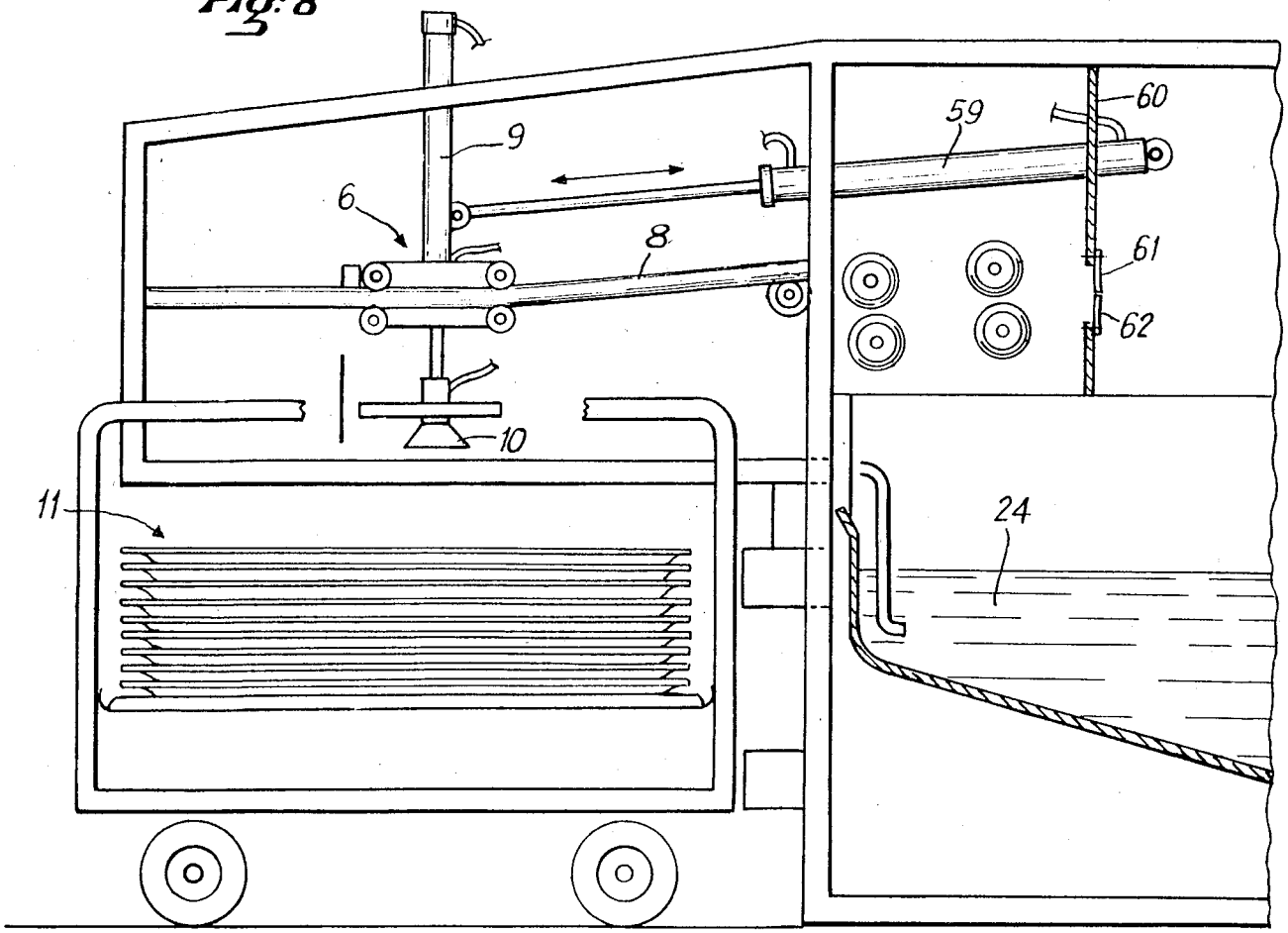
FIG. 8 is a partial sectional view of the end of the machine, corresponding to the upstream storage station and showing the means for gripping the stacked trays at this station.

This device is formed by an element 7 manoeuvred by jack 59 (cf. FIGS. 7 and 8) sliding on a rail assembly 8 and bearing a jack 9 at the base of which a gripping system 10 incorporating suction pads enables the plates, dishes, trays, etc. . . . to be individually gripped and taken to their starting position for supplying the machine.

At the upstream starting station 1, a system may be provided for physically eliminating the solid residue adhering to the plate or the like, for example by means of a projection of a fluid, forcing this residue to drop into a tank 11. The fluid may be a liquid or possibly air and the purpose of this phase is essentially to remove the solid elements from the plate physically so as to deliver to the machine a plate which is dirty but bereft of deposits of solid matter.

According to the invention, the process and the machine for carrying out this process comprise one single wet phase carried out at station 2; at this station, upper nozzles 19 and lower nozzles 20 project jets of detergent water at a temperature of the order of 60° C. against the upper surface and the lower surface of the plate 15; this phase also comprises a brushing operation using a rotary brush 21 which eliminates any deposit on the walls of the plate.

The wall 60 between the washing stations and the arrival of the plates or the like comprise two lips 61, 62 made of elastically deformable material, adapted to allow passage of the articles by taking the shape of and scraping their upper and lower faces. This wall 60 maintains the water in the washing station.

The water flowing from this washing station rejoins tank 24 via the inclined plates 22, 23, and passing through a filter 25 so that the water in the tank does not contain any solid residue, such residue being retained by the filter; this water may be recycled by pump 26 towards the projection nozzles 19 and 20.

The article leaving the washing station is therefore clean but comprises on its surface a wet film of washing water. This water contains the active products (detergents and bactericides) in an appropriate dosage not in excess, but it is obvious that this wet film must be eliminated.

Contrary to heretofore known machines in which elimination is effected by rinsing, which is in fact a dilution of the active products, followed by a drying leading to concentrates of residues on the surface of the article, this operation consuming a great deal of energy, the invention proceeds by physically scraping the wet film in the direction of gravity, the film being driven away in the form of droplets which rejoin the tank 24.

The machine operates continuously and, to this end, the plates, dishes, trays, etc. . . . are conveyed by a drive means constituted by notched belts 12, 12' cooperating with guide rails 13, 13', 14, 14'.

The rails 13, 13', 14, 14' are simple, fixed and passive supports allowing the upward slide of the articles of flat tableware such as plates 15, 15', 16, 16'.

Figure 2:
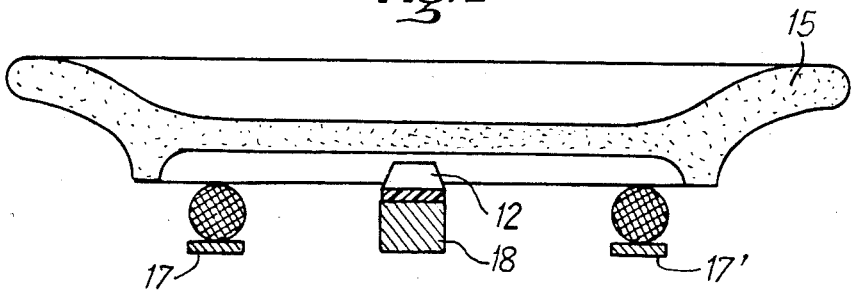
FIG. 2 illustrates a view in detail showing in transverse section the assembly of a plate on the guide and drive means.

The rails are for example constituted by fixed linear supports formed more particularly by beads made of extruded semi-rigid synthetic material offering a smooth outer wall with low coefficient of friction, possibly supported in lower position by a rigid rod such as a flat rod 17, 17' of stainless steel (FIG. 2).

The rails constitute simple slide means ensuring constant positioning of the plates along their upward path and to this end, the rails are disposed along a path on an inclined plane forming an angle of the order of 15° to 20° with respect to the horizontal.

Figure 3:
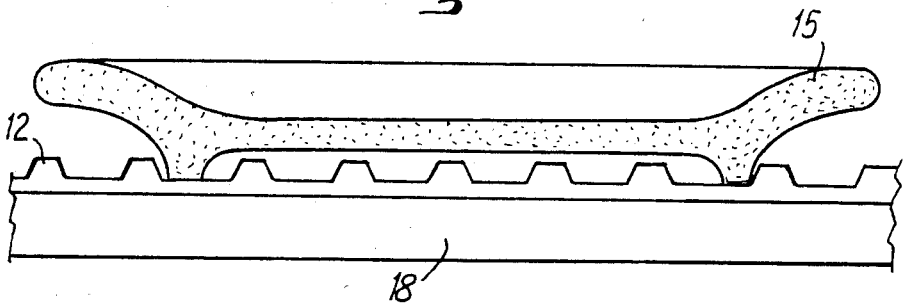
FIG. 3 shows the same view as FIG. 2, this time in longitudinal section.
Figure 4:
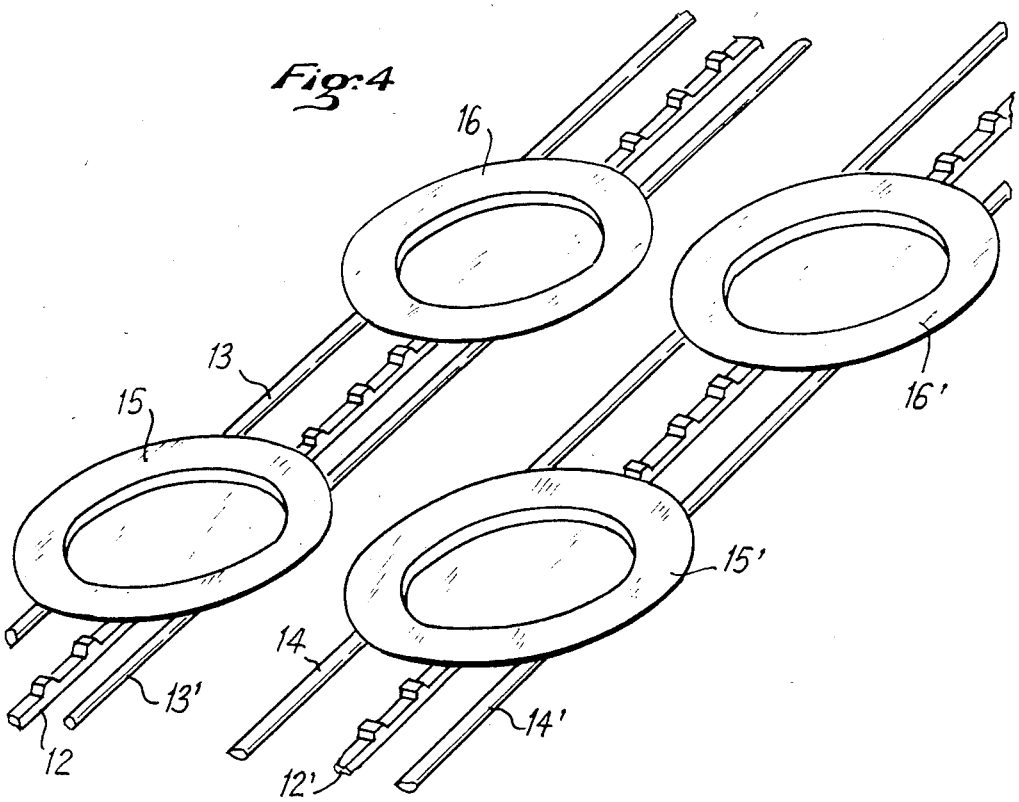
FIG. 4 shows a view in perspective of a set of plates in the course of washing and driven by the guide and drive means.

Between two adjacent rails receiving a set of successive plates is disposed a notched drive belt 12 and 12' which itself rests on a lower support 18 formed for example by a rigid rod of square section, for example made of stainless steel (FIGS. 2 and 3).

The plates are thus conveyed from their arrival at downstream station 1 through the machine and they pass through the washing station 2 and the station 3 where the wet film is eliminated.

According to the embodiment of the invention, said station 3 employs a flat jet of air projected from the upper nozzle 27. Symmetrically, a lower nozzle 28 projects against the bottom of the plate a flat jet of air which scrapes the wet film remaining on said bottom and drives it towards the rear end in the form of droplets which then drop into the tank.

Nozzles 27, 28 project a flat jet of air in an inclined plane with respect to the general plane of the plate at an angle slightly less than the perpendicular and of the order of 75°.

The plates are then conveyed to the service station where they are delivered by the notched belt 12; this service station may be an intermediate waiting station 29 where the individual plates enter by pushing the catch 30 which is repositioned to the rear of the plate, this catch being located at the end of the piston 31 manoeuvred by the jack 32. The piston shown in broken lines in position of extension and in solid lines in position of retraction is adapted to return the plate to the outside, i.e. towards the restacking station.

Figure 5:
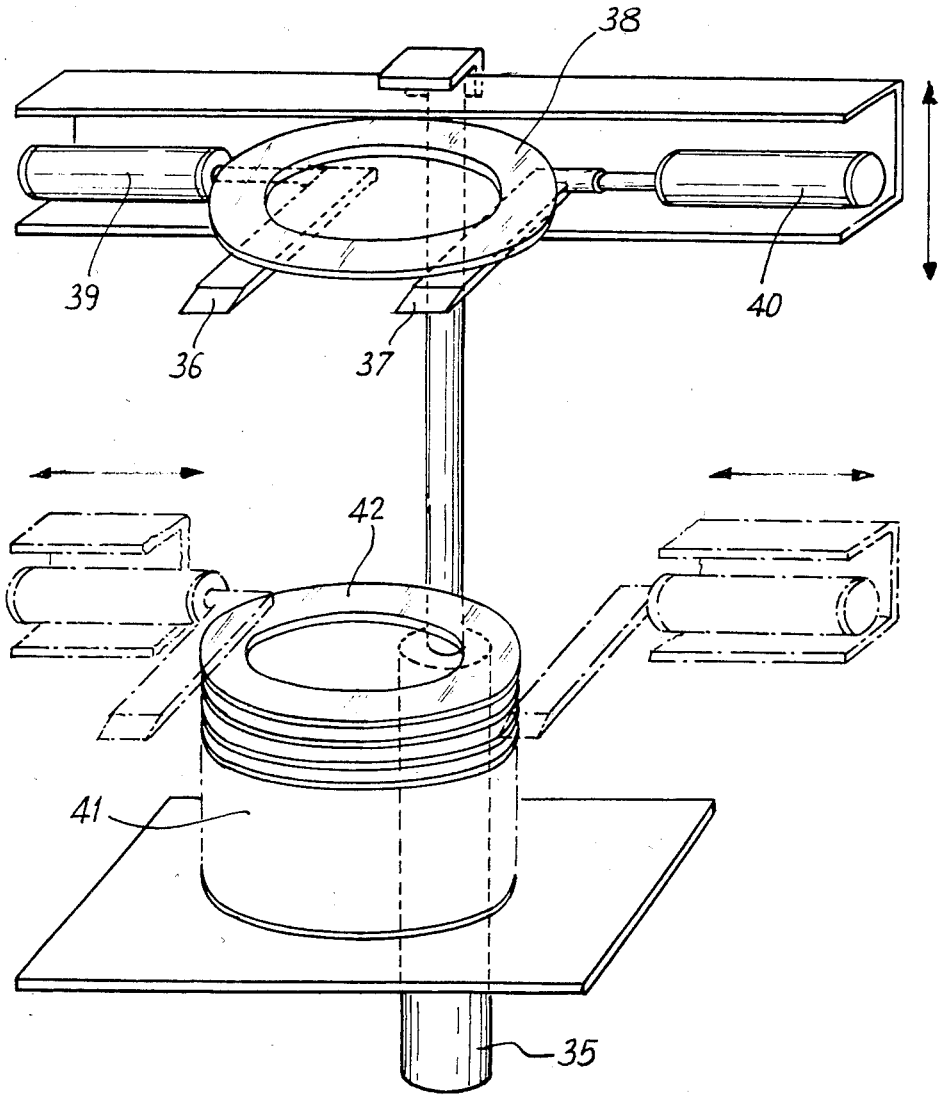
FIG. 5 shows a view in perspective of the system for restacking the clean articles.

At this restacking station is manoeuvred an elevator constituted by a support element 33 mounted on one or two guide columns and manoeuvred by the rod of the piston 34 coming from the vertical manoeuvring jack 35. The element 33 comprises a device for supporting and depositing the plates shown in FIG. 5 and constituted by the two arms 36, 37 for supporting the plate 38 shown in upper position in solid lines (and in lower depositing position in broken lines).

The two arms are each associated with a manoeuvring jack 39, 40 so that the arms may be brought closer to support the plate then moved away to enable the plate to be deposited at the top of the stack.

The assembly constituted by jacks 35, 39 and 40 is associated with a servo-control device (not shown) itself comprising contactors adapted to detect the presence of the plate 38 in position of arrival on the close arms 36 and 37, which controls the start of the cycle with lowering of the element 33 up to the top of the stack 41; stoppage is controlled by a contactor associated with the element 33 and coming for example into abutment on the top plate 42, which provokes the stoppage of the jack and the positioning of the element 33 at an appropriate height; subsequently, the two jacks 39 and 40 are brought into spaced apart position so that the plate 38 is deposited on the top plate 42; after which the element 33 may be raised and the arms 36 and 37 brought closer, to return to the upper or starting position of the cycle.

The invention makes it possible to manufacture a compact, entirely automatic machine.

What is claimed is:

1. In a machine for mechanically washing and drying articles of flat tableware, including trays, plates, dishes or the like, of the type having:

an inlet for introduction of said articles and an outlet for evacuation thereof, a brushing station having means for projecting detergent water, a tank of detergent water supplied by the return of the water coming from said brushing station, means for recycling the water from said tank towards the detergent water projecting means, a drying station with means for projecting air, means for conveying the articles from the inlet to the brushing station, and thereafter to the drying station and to the outlet, said means conveying the articles along an upward path forming an angle of between 10° and 30° with respect to the horizontal, the improvement comprising:

the air projecting means being located immediately downstream of said brushing station, without the interposition of a rinsing station, and comprising a plurality of nozzles disposed transversely with respect to the advance of the articles above and below said articles, said nozzles projecting a flow of air in the form of a flat jet against the surface of the said articles at an angle of between 70° and 80° with respect to the inclined surface of said articles, the said flat jet of air being projected for scraping any detergent water remaining on the articles in the direction opposite the upward movement of said articles, a first storage station located upstream of said inlet for storing articles of tableware stacked horizontally on one another, and gripping means located at said first storage station for gripping and displacing each article of tableware individually for introduction thereof into the said machine inlet and for retrieval by said conveying means, said gripping means at the first storage station comprising suction pads, a vertical first jack at the base of which the said suction pads are located, a sliding element to bear the said first jack, a rail assembly to guide the said sliding element, a substantially horizontal second jack to move the said sliding element, and a second storage station downstream of said outlet adapted to receive the articles stacked horizontally on one another.

2. The machine of claim 1, wherein said first and second storage stations have a removable container mounted on rolling means to constitute a carriage which receives a stack of horizontal articles resting on one another.

3. In a machine for mechanically washing and drying articles of flat tableware, including trays, plates, dishes or the like, of the type having:

an inlet for introduction of said articles and an outlet for evacuation thereof, a brushing station having means for projecting detergent water, a tank of detergent water supplied by the return of the water coming from said brushing station, means for recycling the water from said tank towards the detergent water projecting means, a drying station with means for projecting air, means for conveying the articles from the inlet to the brushing station, and thereafter to the drying station and to the outlet, said means conveying the articles along an upward path forming an angle of between 10° and 30° with respect to the horizontal, the improvement comprising:

the air projecting means being located immediately downstream of said brushing station, without the interposition of a rinsing station, and comprising a plurality of nozzles disposed transversely with respect to the advance of the articles above and below said articles, said nozzles projecting a flow of air in the form of a flat jet against the surface of the said articles at an angle of between 70° and 80° with respect to the inclined surface of said articles, the said flat jet of air being projected for scraping any detergent water remaining on the articles in the direction opposite the upward movement of said articles, a storage station downstream of said outlet to receive a stack of said articles of tableware, said storage station comprising an elevator mounted to slide along a generally vertical axis between the level of said outlet and the top of the stack in said storage station, said elevator comprising two laterally retractable arms and two moving jacks each adapted to control the said arms, a first contactor sensitive to the arrival of an article exiting from said outlet, said contractor being adapted to initiate the downward vertical motion of the elevator, and a second contactor sensitive to the arrival of the elevator at the top of said stack adapted to stop the motion of the elevator and to control the action of said moving jacks, thus moving said arms apart to deposit the article on the top of the stack.

* * * * *